US007735947B2

(12) United States Patent
Okuda

(10) Patent No.: US 7,735,947 B2
(45) Date of Patent: Jun. 15, 2010

(54) DROPLET EJECTING APPARATUS AND DROPLET EJECTING METHOD

(75) Inventor: Masakazu Okuda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 438 days.

(21) Appl. No.: 11/347,594

(22) Filed: Feb. 4, 2006

(65) Prior Publication Data

US 2007/0046704 A1 Mar. 1, 2007

(30) Foreign Application Priority Data

Aug. 25, 2005 (JP) ..... 2005-245085

(51) Int. Cl.
*B41J 29/38* (2006.01)

(52) U.S. Cl. ..... 347/11; 347/9; 347/10

(58) Field of Classification Search ..... 347/9, 347/10, 11

See application file for complete search history.

(56) References Cited

U.S. PATENT DOCUMENTS 6,799,821 B1 * 10/2004 Okuda ..... 347/11
2004/0113961 A1 * 6/2004 Ishikawa ..... 347/11
2004/0155915 A1 * 8/2004 Kitami et al. ..... 347/10

FOREIGN PATENT DOCUMENTS

| | | |
|---|---|---|
| JP | 59-176060 | 10/1984 |
| JP | 2000-276200 | 10/2000 |
| JP | 2000-280463 | 10/2000 |

* cited by examiner

*Primary Examiner*—Matthew Luu
*Assistant Examiner*—Jannelle M Lebron
(74) *Attorney, Agent, or Firm*—Fildes & Outland, P.C.

(57) ABSTRACT

In a droplet ejecting system, after an ink droplet is ejected a reverberation pressure change is amplified to obtain an appropriate amount of reverberation pressure change, and the ink droplet is reliably separated from a meniscus when ejecting the ink droplet. To this end, voltage including an ejecting pulse for ejecting the ink droplet is applied to a piezoactuator to generate a pressure change in a pressure chamber, and voltage including a reverberation amplifying pulse is applied to the piezoactuator to amplify the pressure change in the pressure chamber in the next cycle subsequent to the cycle of the pressure change generated by the ejecting pulse.

9 Claims, 12 Drawing Sheets

DROPLET EJECTING APPARATUS AND DROPLET EJECTING METHOD

CROSS-REFERENCE TO RELATED APPLICATION

This application claims priority under 35 USC 119 from Japanese Patent Application No. 2005-245085, the disclosure of which is incorporated by reference herein.

BACKGROUND OF THE INVENTION

1. Field of the Invention

The present invention relates to a droplet ejecting apparatus and a droplet ejecting method, particularly to the droplet ejecting apparatus and droplet ejecting method for ejecting a droplet based on an applied voltage.

2. Description of the Related Art

Conventionally, in a droplet ejecting head in which an electromechanical transducer such as a piezoactuator is used, a pressure change is generated in a pressure chamber to eject a droplet by applying a voltage to the electromechanical transducer.

Because the state of generation of satellite drops and mist is changed by a reverberation pressure change in the pressure chamber after a droplet is ejected by the applied voltage, satellite drops and mist are generated, which causes degradation of image quality and a decrease in apparatus reliability, unless the reverberation pressure change is appropriately set. That is, when flight speed of the satellite drops is slow, a large difference in landing position is generated between the satellite drops and the droplets ejected by the applied voltage waveform, which causes problems that the image quality deteriorates and droplet ejection failure is generated.

Japanese Patent Application Laid-Open (JP-A) No. 59-176060 discloses an inkjet head driving method of suppressing the generation of satellite drops and mist. In the method disclosed in JP-A No. 59-176060, ink droplets are ejected by applying a main driving signal to a piezoelectric element, and a driving signal having a reverse phase is applied to a natural oscillation excited in association with the ink droplet ejection. Japanese Patent Application Laid-Open (JP-A) No. 2000-280463 and No. 2003-276200 disclose methods of driving an ink ejection apparatus. In the methods disclosed in JP-A No. 2000-280463 and 2003-276200, a non-ejecting pulse is applied so as to suppress remaining pressure wave vibrations generated by the ejecting pulse in an ink channel after the ink droplet ejection.

In the inkjet driving method disclosed in JP-A No. 59-176060 and the method of driving the ink ejection apparatus disclosed in JP-A No. 2000-280463 or 2003-276200, when a liquid having large viscosity is ejected, because an attenuation constant of the pressure change is increased, the reverberation pressure change is attenuated rapidly immediately after the ink droplet is ejected, and an appropriate amount of reverberation for preventing satellite drops and mist cannot be obtained. That is, because reverberation becomes too little immediately after the ink droplet is ejected, the ink droplet is slowly separated from the meniscus, and the methods are susceptible to low-speed satellite drops and mist generation.

SUMMARY OF THE INVENTION

In view of the foregoing, the present invention has been made to provide a droplet ejecting apparatus and a droplet ejecting method which can effectively prevent the generation of low-speed satellite drops and mist and prevent the degradation of image quality.

A droplet ejecting apparatus according to a first aspect of the invention is a droplet ejecting apparatus including a pressure chamber filled with a liquid and an electromechanical transducer which changes the pressure in the pressure chamber according to an applied voltage, the droplet ejecting apparatus including a droplet ejecting head which ejects a droplet according to the pressure change; and an applying unit which applies the voltage including an ejecting pulse and a reverberation amplifying pulse to the electromechanical transducer, the ejecting pulse ejecting the droplet, and the reverberation amplifying pulse amplifying the pressure change in the next cycle subsequent to the cycle of the pressure change generated by the ejecting pulse in the pressure chamber.

A droplet ejecting method according to a second aspect of the invention is a droplet ejecting method for a droplet ejecting apparatus, including a pressure chamber filled with a liquid, an electromechanical transducer which changes the pressure in the pressure chamber according to an applied voltage, and a droplet ejecting head which ejects a droplet according to the pressure change, comprising applying a voltage including an ejecting pulse and a reverberation amplifying pulse is applied to the electromechanical transducer, ejecting the droplet using the ejecting pulse, amplifying the pressure change in the pressure chamber in the next subsequent cycle to the cycle of the pressure change generated by the ejecting pulse using the reverberation amplifying pulse.

DETAILED DESCRIPTION OF THE INVENTION

Embodiments of the present invention will be described in detail below with reference to the accompanying drawings. In the following embodiments, the invention is applied to an inkjet recording apparatus by way of example.

Figure 1:
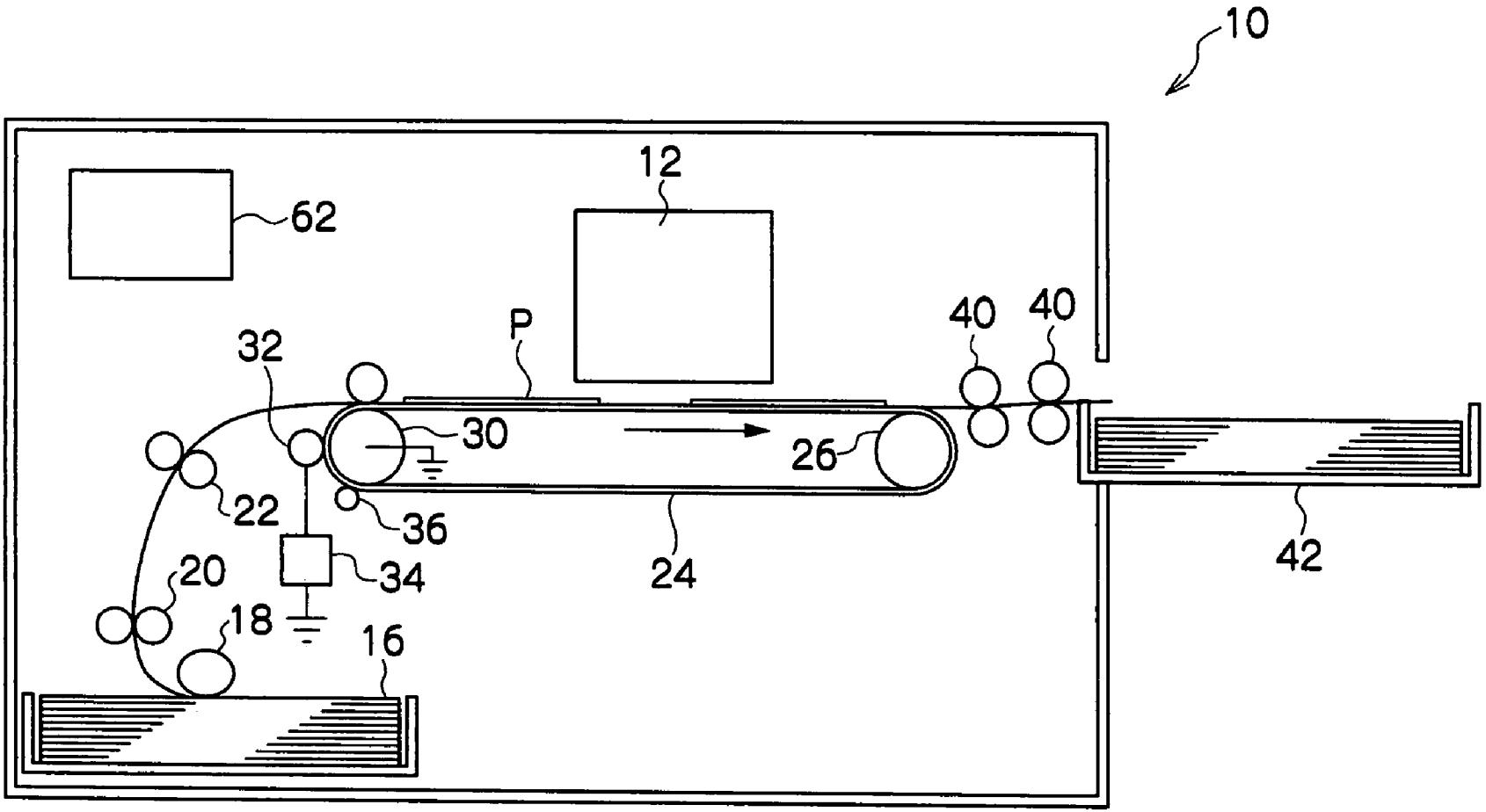
FIG. 1 is a schematic view showing a configuration of an inkjet recording apparatus according to a first embodiment of the present invention.

Referring to FIG. 1, an inkjet recording apparatus 10 according to a first embodiment of the invention includes an inkjet head unit 12 which ejects ink droplets onto a recording sheet P. The inkjet head unit 12 includes inkjet heads (not shown) which eject cyan (C), magenta (M), yellow (Y), and black (B) ink droplets from respective nozzles. The inkjet heads are long heads having an effective print area larger than a width of the recording sheet P. The inkjet heads eject the ink droplets to all the print area in a crosswise direction of the recording sheet P at the same time. The method of ejecting the ink droplet from the nozzle of the inkjet head is one in which the pressure chamber is pressurized by a piezoactuator. The pressure chamber pressurizing method differs largely from a TIJ (thermal inkjet) method in that the generation of satellite drops and mist can be suppressed by controlling the reverberation pressure change within the pressure chamber with the applied voltage immediately after the ink droplet is ejected.

A main scan mechanism which moves the inkjet head in a main scan direction may be provided in the inkjet head unit 12 to apply an inkjet head whose effective print area is smaller than the width of the recording sheet P.

High-viscosity ink is used in the inkjet head. For example, the viscosity is 20 mP.s.

The demand for ejecting liquids having a high viscosity is increasing. That is, in inkjet recording apparatuses, ink feathering into the recording sheet is decreased by the use of high-viscosity ink, which enables high-quality image recording or double-side printing. In industrial applications other than image recording, when a liquid having high viscosity is ejected, there is an advantage that the range of applications of the inkjet recording apparatus can considerably be enlarged.

A sheet-feed tray 16 is detachably provided in a lower-most portion of the inkjet recording apparatus 10. The recording sheets P are loaded on the sheet-feed tray 16, and a pickup roller 18 abuts on the top of the recording sheets P. The recording sheets P are fed one by one from the sheet-feed tray 16 toward the downstream side in a conveyance direction, and the recording sheets P are fed below the inkjet head unit 12 by conveying rollers 20 and 22 sequentially provided along a conveyance path.

An endless conveying belt 24 is provided below the inkjet head unit 12 and tensioned by a drive roller 26 and a driven roller 30. The driven roller 30 is grounded.

A charging roller 32 is arranged on the upstream side of the position where the recording sheet P comes into contact with the conveying belt 24, and the charging roller 32 is connected to a direct-current power supply 34 which supplies direct current. The charging roller 32 is driven while sandwiching the conveying belt 24 with the driven roller 30. The charging roller 32 is configured to be moved between a contact position where the charging roller 32 comes into contact with the conveying belt 24 and a separation position where the charging roller 32 is separated from the conveying belt 24. Because a predetermined potential difference between the charging roller 32 and the grounded driven roller 30 is generated at the contact position, the charging roller 32 is discharged to the conveying belt 24 to impart a charge.

An antistatic roller 36 which eliminates the charge of the conveying belt 24 is provided on the upstream side of the charging roller 32.

Plural pairs of discharge rollers 40 constituting a discharge path of the recording sheet P are provided on the downstream side of the inkjet head unit 12. A sheet-discharge tray 42 is provided downstream of, and on the discharge path formed by, the pairs of discharge rollers 40.

A controller 62 including CPU, ROM, and RAM is provided in the inkjet recording apparatus 10. The controller 62 controls the whole of the inkjet recording apparatus 10 including plural motors (not shown) which drive the inkjet head unit 12 and the rollers.

Figure 2:
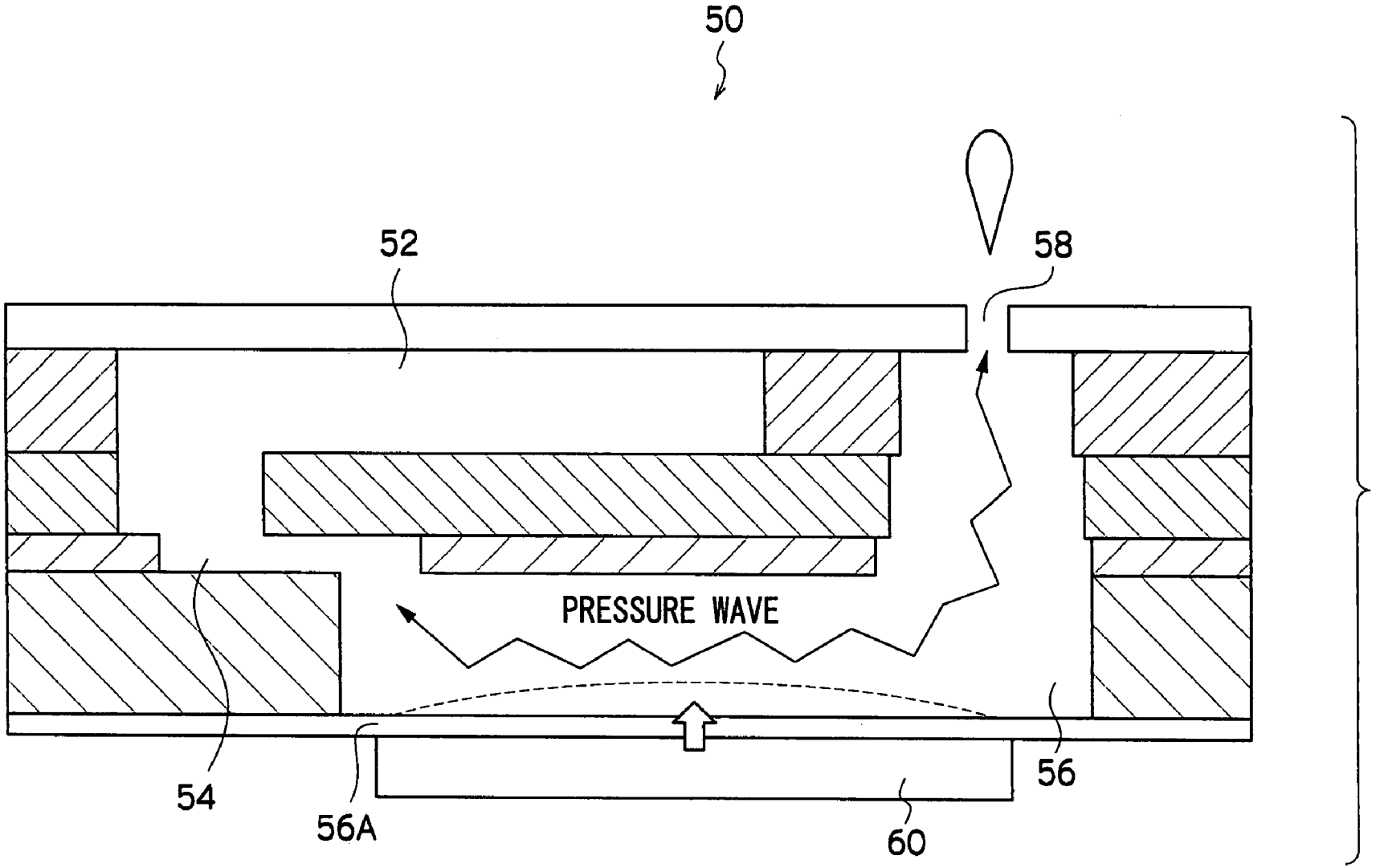
FIG. 2 is a sectional view showing a configuration of an inkjet head according to the first embodiment of the invention.

Referring to FIG. 2, an inkjet head 50 per each nozzle of the inkjet head unit 12 includes an ink tank 52, a supply path 54, a pressure chamber 56, a nozzle 58, and a piezoactuator 60 which is of the electromechanical transducer.

The ink tank 52 is filled with ink, and the pressure chamber 56 is also filled with ink through the supply path 54 to supply the ink to the nozzle 58 communicated with the pressure chamber 56.

A part of the surface walls of the pressure chamber 56 is formed by a diaphragm 56A, and a piezoactuator 60 is provided in the diaphragm 56A. The piezoactuator 60 deforms and vibrates the diaphragm 56A to generate a pressure change in the pressure chamber 56. That is, the pressure change generated by the vibration of the piezoactuator 60 ejects the ink, with which the pressure chamber 56 is filled, from the nozzle 58 in the form of an ink droplet. The pressure chamber 56 is replenished with the ink from the ink tank 52 through the supply path 54.

The recording head is formed by arranging, for example, the plural nozzles 58 in the crosswise direction of the recording sheet. The image in the crosswise direction of the recording sheet is recorded, and the recording sheet and the recording head are relatively moved, which allows the image to be recorded on the recording sheet.

Figure 3:
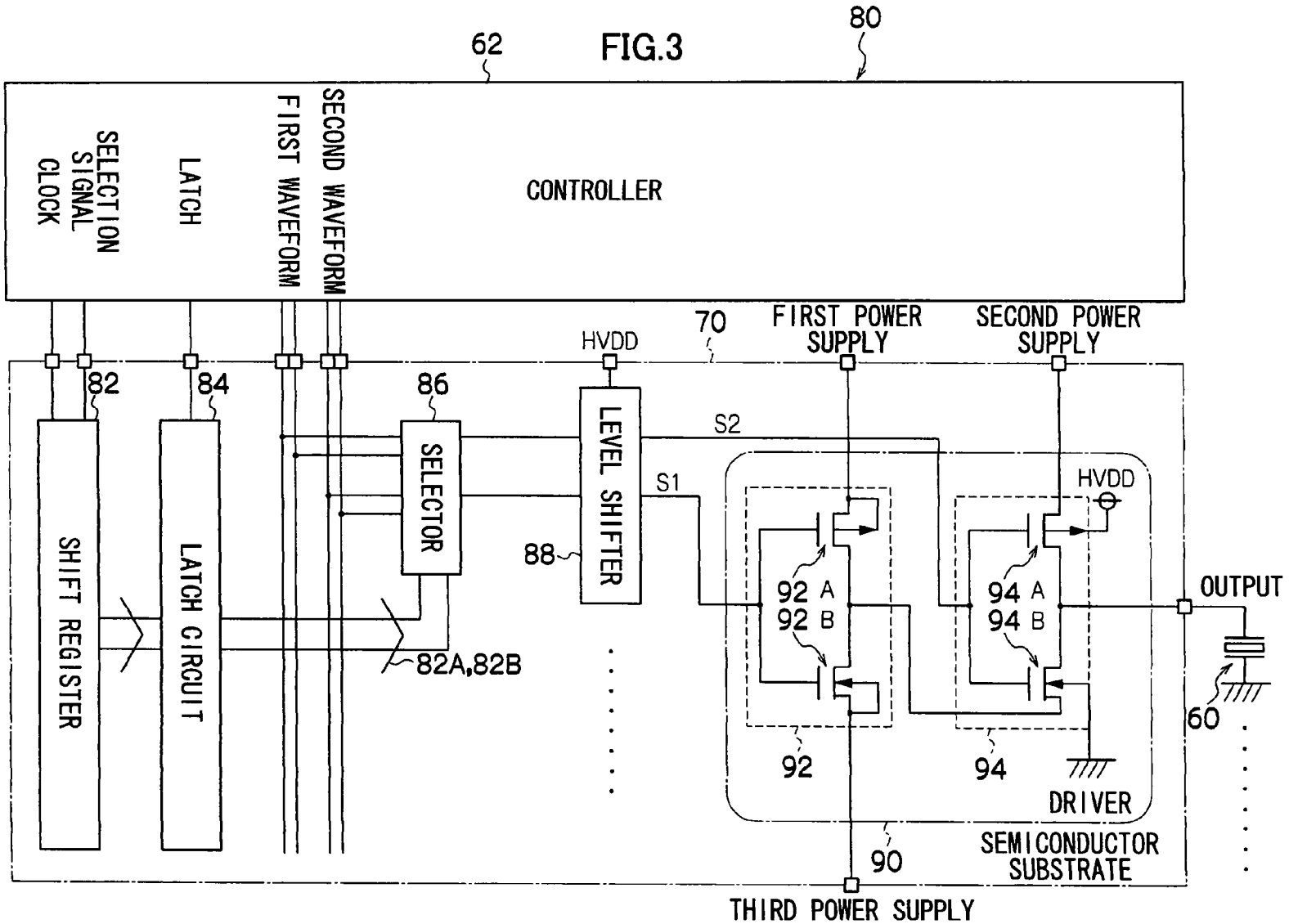
FIG. 3 is a circuit diagram showing a drive circuit of the inkjet recording apparatus according to the first embodiment of the invention.

Referring to FIG. 3, a drive circuit 80 which drives the inkjet head 50 in the inkjet recording apparatus 10 includes a shift register 82, a latch circuit 84, a selector 86, a level shifter 88, and a driver 90 on a semiconductor substrate 70.

A clock signal and a selection signal, outputted from the controller 62, are inputted to the shift register 82. A latch signal, outputted from the controller 62, is inputted to the latch circuit 84.

The selection signal selects a pair of a first waveform or a pair of a second waveform, and the selection signal is a serial signal including a first waveform selection signal 82A and a second waveform selection signal 82B. The first waveform selection signal 82A and the second waveform selection signal 82B are one-bit data indicating either "0" or "1". The first waveform selection signal 82A indicates "1" when the first waveform is selected, and the first waveform selection signal 82A indicates "0" when the first waveform is not selected. Similarly, the second waveform selection signal 82B indicates "1" when the second waveform is selected, and the second waveform selection signal 82B indicates "0" when the second waveform is not selected.

That is, the selection signal becomes the two-bit serial data of "10" when the first waveform is selected, and the selection signal becomes the two-bit serial data of "01" when the second waveform is selected. Such selection signals corresponding to the number of piezoactuators 60 are continuously inputted to the shift register 82.

Although the case in which the voltage is applied to the one piezoactuator 60 is described below, the voltages are applied to other piezoactuators 60 in the same manner, so that the description of other piezoactuators 60 will be omitted.

The shift register 82 converts the selection signal, which is of the inputted two-bit serial data, into two-bit parallel data to output the two-bit parallel data to the latch circuit 84.

The latch circuit 84 latches the parallel data, outputted from the shift register 82, according to the input of the latch signal.

In the selector 86, the parallel data of the selection signal latched by the latch circuit 84 is inputted to a select terminal, while the pair of the first waveform and pair of the second waveform, which are of the signal to be selected, are inputted from the controller 62. Accordingly, the selector 86 selects the waveform signal, directed by the selection signal, from the pair of the first waveform and the pair of the second waveform and the selector 86 outputs the waveform signal.

A waveform-signal output terminal of the selector 86 is connected to the level shifter 88, and the waveform signal outputted from the selector 86 is level-shifted and outputted by the level shifter 88. Electric power having a predetermined voltage level HVDD is supplied from a fourth power supply (not shown) to the level shifter 88, and the level shifter 88 level-shifts the waveform signal selected by the selection signal to a voltage level corresponding to the voltage level HVDD.

The driver 90 includes a first signal generating circuit 92 and a second signal generating circuit 94. The first signal generating circuit 92 according to the first embodiment is configured in the form of an inverter circuit in which PMOS 92A and NMOS 92B are connected in series. Similarly the second signal generating circuit 94 is configured in the form of an inverter circuit in which PMOS 94A and NMOS 94B are connected in series.

In the first signal generating circuit 92, the drains of PMOS 92A and NMOS 92B are connected to each other, and the gates of PMOS 92A and NMOS 92B are connected to each other. Similarly, in the second signal generating circuit 94, the drains of PMOS 94A and NMOS 94B are connected each other, and the gates of PMOS 94A and NMOS 94B are connected to each other.

Electric power having a predetermined voltage level Hv1 is supplied from a first power supply (not shown) to a source of PMOS 92A in the first signal generating circuit 92, and electric power having a predetermined voltage level HV3 is supplied from a third power supply (not shown) to the source of PMOS 92B. The gates of PMOS 92A and NMOS 92B are connected to one of the output terminals of the level shifter 88, and a waveform signal S1 is inputted to the gates of PMOS 92A and NMOS 92B. The waveform signal S1 is one of the pair of waveform signals selected by the selector 86, and the waveform signal S1 is level-shifted by the level shifter 88. Voltage level HV1>voltage level HV3 holds in a relationship between the voltage level HV1 and the voltage level HV3.

In the first signal generating circuit 92, when the signal level of the waveform signal S1 inputted from the level shifter 88 is at a high level, PMOS 92A is in an off state and NMOS 92B is in an on state, so that the voltage level of the outputted voltage becomes the voltage level HV3. On the other hand, when the signal level of the waveform signal S1 inputted from the level shifter 88 is at a low level, PMOS 92A is in the on state and NMOS 92B is in the off state, so that the voltage level of the outputted voltage becomes the voltage level HV1. As a result, in the voltage outputted from the first signal generating circuit 92, the waveform is the same shape as the reverse waveform of the waveform signal S1 inputted from the level shifter 88, and the voltage level has the voltage levels of HV3 and HV1.

Electric power having a predetermined voltage level HV2 is supplied from a second power supply (not shown) to the source of PMOS 94A in the second signal generating circuit 94, and the source of NMOS 94B is connected to a connection point (drain) of PMOS 92A and NMOS 92B in the first signal generating circuit 92. Accordingly, the inverter output of the first signal generating circuit 92 is applied to the source of NMOS 94B. The gates of PMOS 94A and NMOS 94B are connected to the other output terminal of the level shifter 88, and a waveform signal S2 is inputted to the gates of PMOS 94A and NMOS 94B. The waveform signal S2 is the other of the pair of waveform signals selected by the selector 86, and the waveform signal S2 is level-shifted by the level shifter 88.

In the second signal generating circuit 94, when the signal level of the waveform signal S2 inputted from the level shifter 88 is at the high level, PMOS 94A is in the off state and NMOS 94B is in the on state, so that the voltage level of the outputted voltage becomes the same voltage outputted from the first signal generating circuit 92 (the waveform is to the same shape as the reverse waveform of the waveform signal S2 inputted from the level shifter 88, and the voltage level has the voltage levels HV3 and HV1). On the other hand, when the signal level of the waveform signal S2 inputted from the level shifter 88 is at the low level, PMOS 94A is in the on state and NMOS 94B is in the off state, so that the voltage level of the outputted voltage becomes the voltage level HV2. As a result, the voltage outputted from the second signal generating circuit 94 has three voltage levels of the voltage levels HV1, HV2, and HV3. The three voltage levels are formed by combining the voltages outputted from the first signal generating circuit 92 and the second signal generating circuit 94 according to the pair of waveform signals S1 and S2 inputted from the level shifter 88.

For example, when the voltage level of the output voltage is to be set at the voltage level HV2, it is arranged so that the voltage level of the output waveform from the second signal generating circuit 94 is set at the voltage level HV2. Accordingly, the waveform signal S2 inputted to the second signal generating circuit 94 is set at the low level. In this case, because the output of the first signal generating circuit 92 has no influence on the output of the second signal generating circuit 94, there is no restriction in the level of the waveform signal S1 inputted to the first signal generating circuit 92.

When the voltage level of the output voltage is to be set at the voltage level HV1, it is necessary that the voltage level of the output waveform from the first signal generating circuit 92 is set at the voltage level HV1, and the voltage level of the output waveform from the second signal generating circuit 94 is also set at the voltage level HV1. Accordingly, the waveform signal S1 inputted to the first signal generating circuit 92 is set at the low level, and the waveform signal S2 inputted to the second signal generating circuit 94 is set at the high level.

When the voltage level of the output voltage is to be set at the voltage level HV3, it is necessary that the voltage level of the output waveform from the first signal generating circuit 92 is set at the voltage level HV3, and the voltage level of the output waveform from the second signal generating circuit 94 is also set at the voltage level HV3. Accordingly, the waveform signal S1 inputted to the first signal generating circuit 92 is set at the high level, and the waveform signal S2 inputted to the second signal generating circuit 94 is also set at the high level.

In the inkjet recording apparatus 10 of the first embodiment, the relationship between the voltage level HVDD of the electric power supplied from a fourth power supply (not shown) and the voltage level HV2 of the electric power supplied from the second power supply is set such that voltage level HVDD is equal to or larger than (≧) voltage level HV2, and the relationship between the voltage level HV2 and the voltage level HV1 of the electric power supplied from the first power supply is set such that voltage level HV2>voltage level HV1.

Figure 4A:
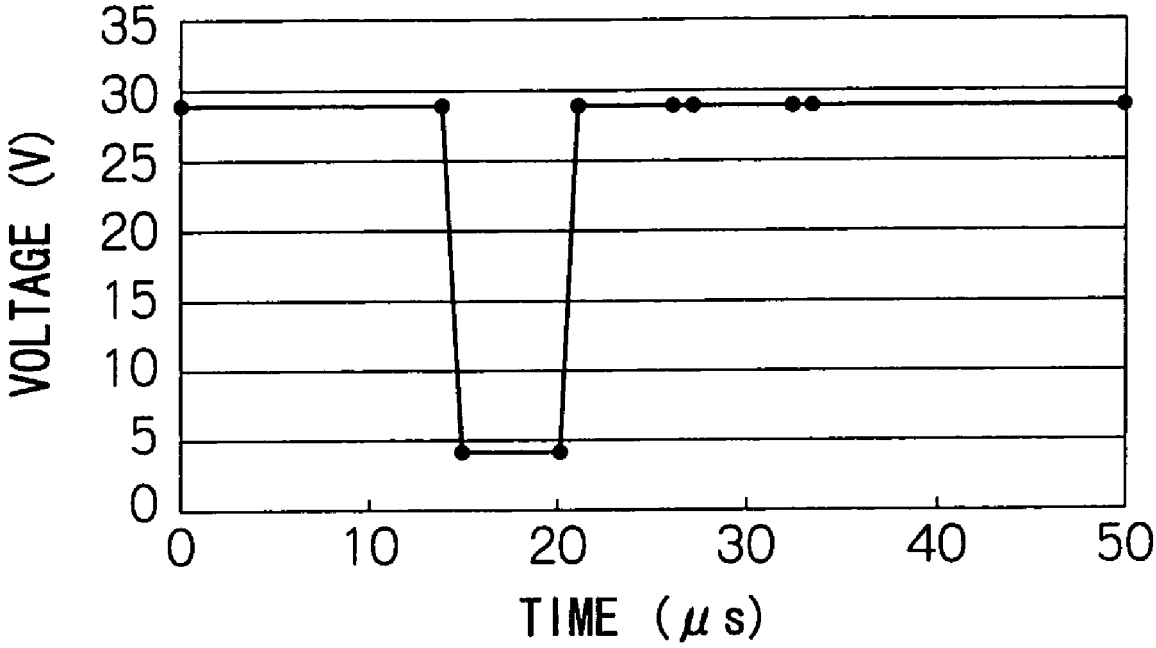
FIG. 4A shows a voltage applied to a piezoactuator.
Figure 4B:
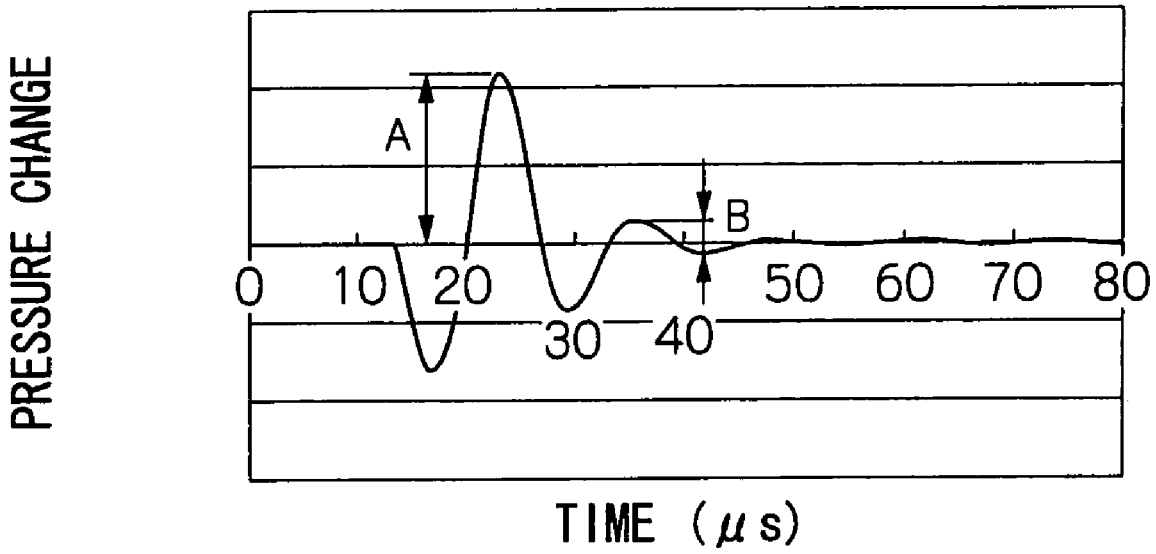
FIG. 4B shows a pressure change within a pressure chamber.

Next, the pressure change in the pressure chamber 56 of the inkjet head 50 will be described. In the ink droplet ejection with the piezoactuator 60, as shown in FIG. 4A, when a voltage having one pulse is applied to the piezoactuator 60, the pressure chamber 56 is expanded by the falling of the pulse, and the pressure chamber 56 is contracted by the rising of the pulse. That is, as shown in FIG. 4B, after the pressure in the pressure chamber 56 falls down from a normal pressure at the falling edge of the pulse, the pressure returns to the normal pressure. Then, the pressure in the pressure chamber 56 rises at the rising edge, and then the pressure returns to the normal pressure. Then, after the pressure in the pressure chamber 56 falls down below the normal pressure because the pressure change reverberates, the pressure returns to the normal pressure, then the pressure rises from the normal pressure, and the pressure returns to the normal pressure. This pattern of pressure changes is repeated while being attenuated.

Here, a droplet is ejected from the nozzle by the pressure change of the first cycle (fall and rise of pressure), and satellite drop(s) and mist are generated by the pressure change of the next cycle.

In the first embodiment, because high-viscosity ink is used, the attenuation of the waveform amplitude showing the pressure change is dramatic, and reverberation intensity is remarkably decreased immediately after ejection. In order to prevent the generation of low-speed satellite drops and mist, it is desirable that a ratio of rise value B/rise value A be about ⅓ to about ½. However, sufficient reverberation intensity cannot be obtained when high-viscosity ink is used.

Next, the action in ejecting an ink droplet with the inkjet head 50 will be described.

Figure 5A:
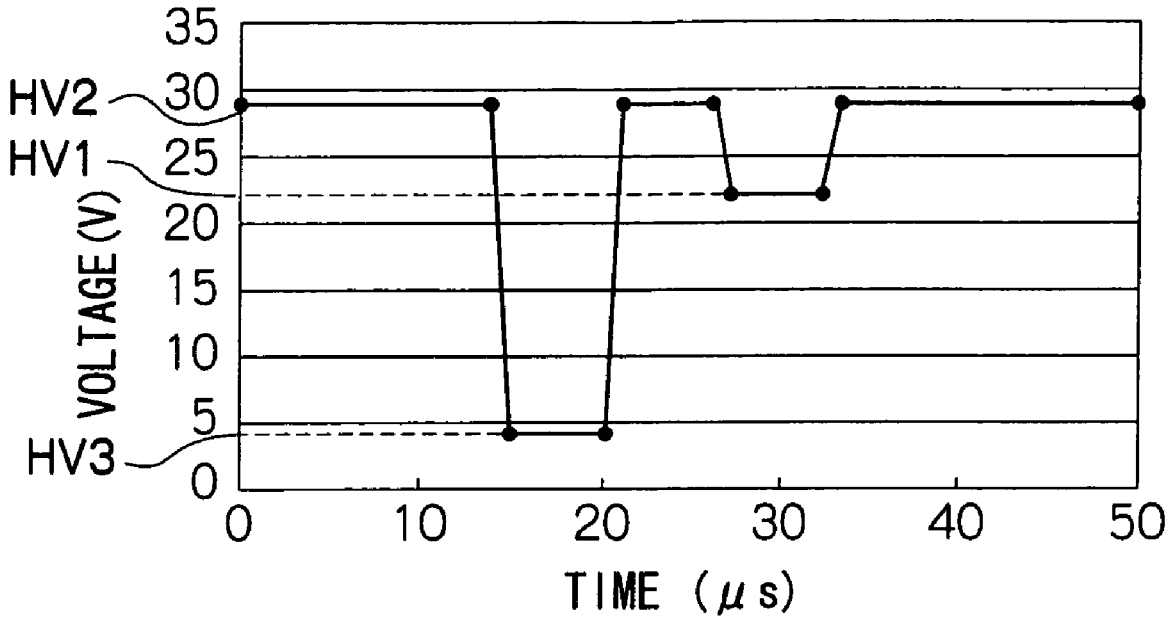
FIG. 5A shows a voltage including a reverberation amplifying pulse applied to the piezoactuator according to the first embodiment of the invention.

For example, if the pair of the first waveform and the pair of the second waveform are used as an ejecting pulse waveform and a reverberation amplifying pulse waveform respectively, in the case where "1" is set at high and "0" is set at low, in the pair of the first waveforms, the level shifter 88 converts and outputs the voltage level by setting each of the pair of pulse waveforms at "0111111100" when the selector 86 selects the first waveform. The voltage has the voltage level HV2 when both the waveform signals S1 and S2 are set at low "0", and the voltage has the voltage level HV3 when both the waveform signals S1 and S2 are set at high "1".The voltage waveform of the ejecting pulse is shown on the left side of FIG. 5A.

For example, in a case where "1" is set at high and "0" is set at low in the pair of second waveforms, the level shifter 88 converts and outputs the voltage level by setting one of the pair of pulse waveforms at "0111100000" and by setting the other pulse waveform at "0000000000", when the selector 86 selects the first waveform. The pulse waveform of "0111100000" is applied for the waveform signal S1 and the pulse waveform of "0000000000" is applied for the waveform signal S2. Accordingly, the voltage has the voltage level HV2 when both the waveform signals S1 and S2 are set at low "0", and the voltage has the voltage level HV1 when the waveform signal S1 is set at high "1" while the waveform signal S2 is set at low "0". The voltage waveform of the reverberation (residual oscillation amplifying pulse is shown on the right side of FIG. 5A.

The pairs of the first waveform and the second waveform (S1 and S2) are stored in the controller 62 such that the pulse widths of the outputted ejecting pulse and reverberation amplifying pulse become around ½ of the Helmholtz resonance period Tc of the inkjet head 50, and the selection signal is stored in the controller 62 such that the time interval between the ejecting pulse and the reverberation amplifying pulse becomes Tc/2.

The controller 62 outputs the selection signal, the first waveform, and the second waveform, and the controller 62 applies the voltage to the piezoactuator 60. The voltage has the ejecting pulse and reverberation amplifying pulse whose pulse widths are substantially set at ½ of the Helmholtz resonance period Tc, and the time interval between the ejecting pulse and the reverberation amplifying pulse is substantially set at Tc/2.

Therefore, a pressure change having the same phase as the pressure change generated by the ejecting pulse is generated by the reverberation amplifying pulse. As shown in FIG. SB, in the pressure change within the pressure chamber 56, the ratio of rise value B'/rise value A' becomes about ⅓ to about ½, and the reverberation of the pressure change is efficiently amplified. Accordingly, since an appropriate amount of reverberation pressure change can be obtained, the ink droplet is well separated from the meniscus to prevent the generation of the low-speed satellite drops and mist.

Thus, according to the inkjet recording apparatus of the first embodiment, a voltage having a reverberation amplifying pulse is applied to the piezoactuator. The reverberation amplifying pulse amplifies the pressure change in the pressure chamber generated by the ejecting pulse in the first cycle episode for the second cycle episode. Therefore, reverberation pressure change is amplified after the ink droplet is ejected, and the ink droplet is well separated from the meniscus in ejecting the ink droplet, so that the generation of the low-speed satellite drops and mist can effectively be prevented and degradation of image quality can be prevented.

Figure 5B:
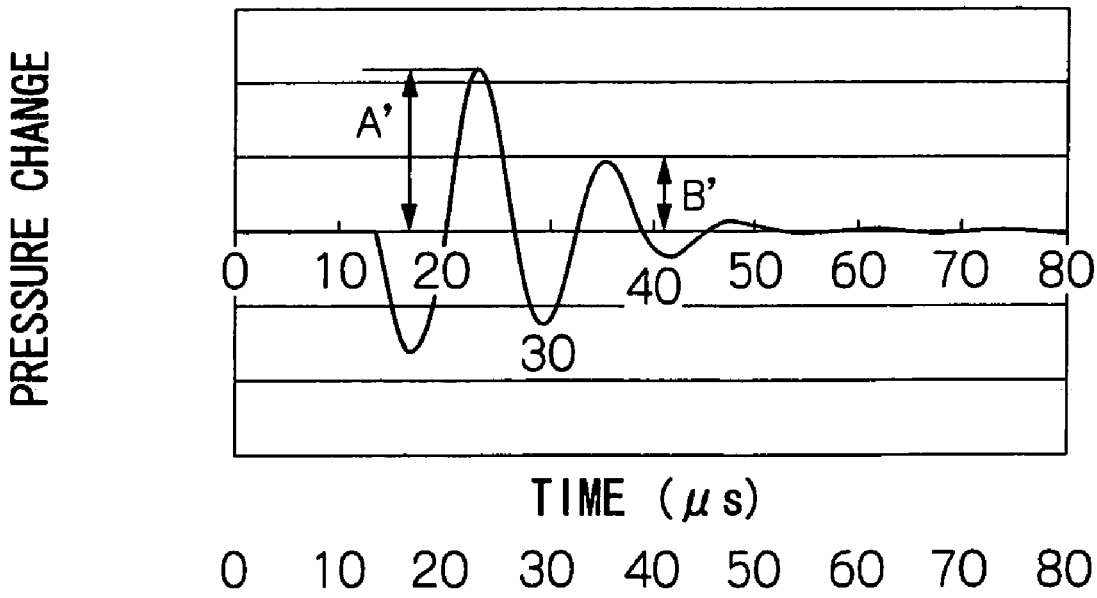
FIG. 5B shows the pressure change within the pressure chamber.

As used herein, "amplify the pressure change, generated by the ejecting pulse, of the second cycle in the pressure chamber" shall mean that a pressure peak (height B') generated subsequent to the pressure peak (height A') by which the droplet is ejected is amplified as shown in FIG. 5B. It is not always necessary that the time interval between the peaks coincide with a resonance period of the pressure wave (Helmholtz resonance period).

The circuit cost and power consumption can be decreased by the method in which the number of voltage levels is limited to three values and applying a voltage having rectangular waveform. In particularly the method is an extremely effective voltage applying method for a full sheet-width application head (FWA head).

The pressure can efficiently be changed in the pressure chamber by setting the pulse width of the ejecting pulse at about ½ of the Helmholtz resonance period.

The time interval between the ejecting pulse and the reverberation amplifying pulse is set at about ½ of the Helmholtz resonance period of the pressure change. This enables the pressure change having the same phase as the pressure change generated by the ejecting pulse to be generated by the reverberation amplifying pulse to efficiently amplify the reverberation pressure change.

In the case where the ink has a large viscosity, since the pressure change is rapidly attenuated in the pressure chamber, the reverberation pressure change suitable to the prevention of the low-speed satellite drops cannot be obtained. However, in the inkjet recording apparatus of the first embodiment, the generation of the low-speed satellite drops can be prevented.

Figure 6A:
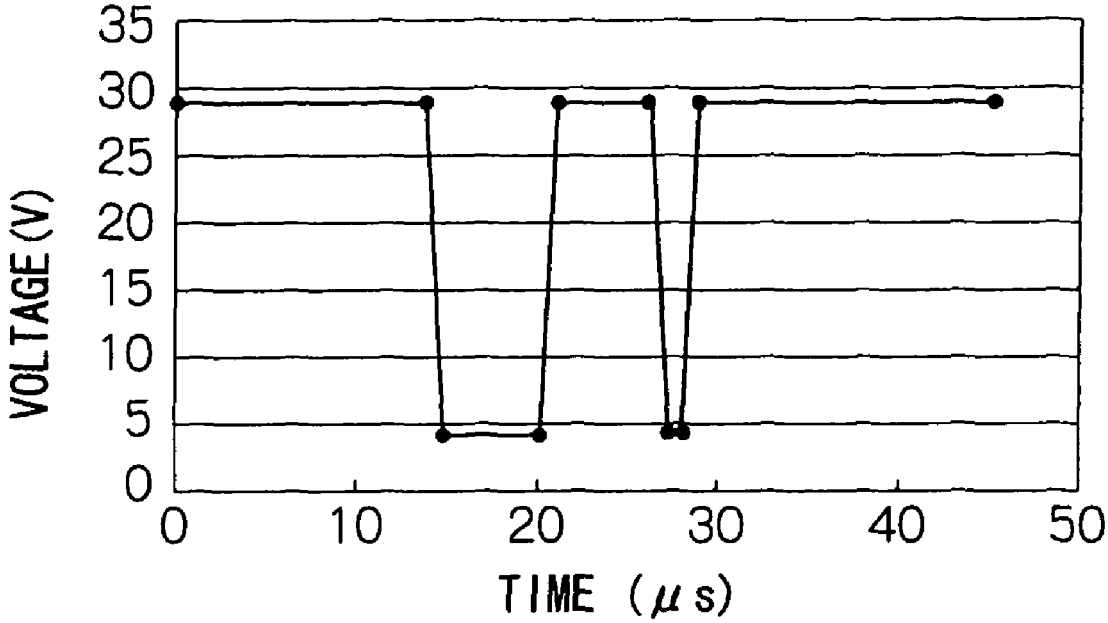
FIG. 6A shows a voltage including a reverberation amplifying pulse applied to a piezoactuator according to a second embodiment of the invention.

A second embodiment will be described below. In the second embodiment, the same components as the first embodiment are designated by the same numerals, and the description thereof will be omitted. As shown in FIG. 6A, the second embodiment differs from the first embodiment in that the voltage level of the reverberation amplifying pulse subsequent to the ejecting pulse for ejecting the droplet is similar to the voltage level of the ejecting pulse.

Figure 6B:
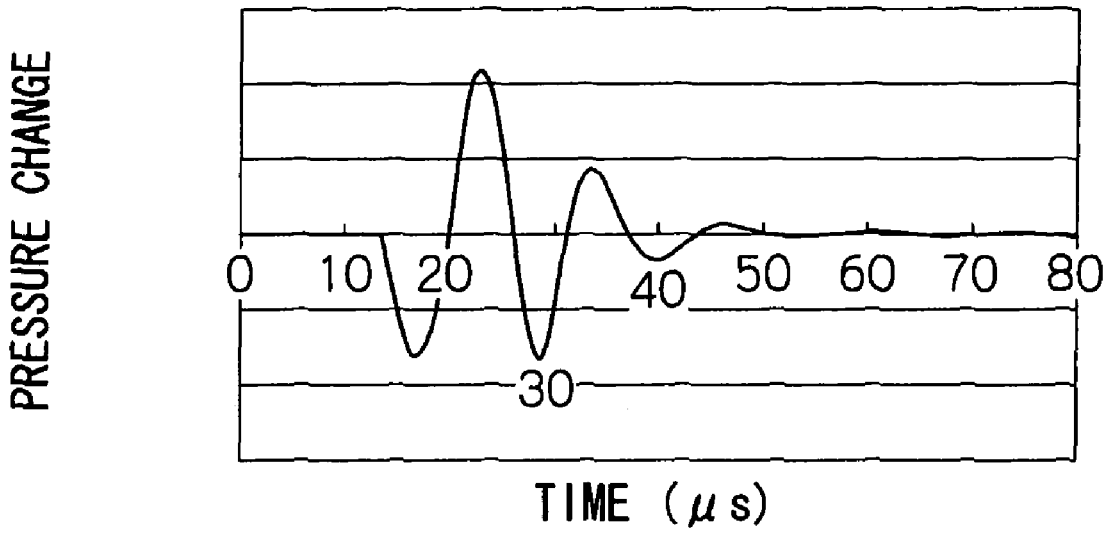
FIG. 6B shows a pressure change within a pressure chamber.

The pulse width of the ejecting pulse is set at about Tc/2, and the pulse width of the reverberation amplifying pulse is set smaller than the pulse width of the ejecting pulse. In the case of a binary rectangular waveform, the amplification of the reverberation pressure change by the reverberation amplifying pulse cannot be controlled by the voltage level. However, as shown in FIG. 6B, an appropriate amount of the amplification of reverberation pressure change can be realized by setting a small pulse width of the reverberation amplifying pulse.

The time interval between the ejecting pulse and the reverberation amplifying pulse is set at about Tc/2. This enables a pressure change having the same phase as the pressure change generated by the ejecting pulse to be generated by the reverberation amplifying pulse to efficiently amplify the reverberation pressure change.

Figure 7:
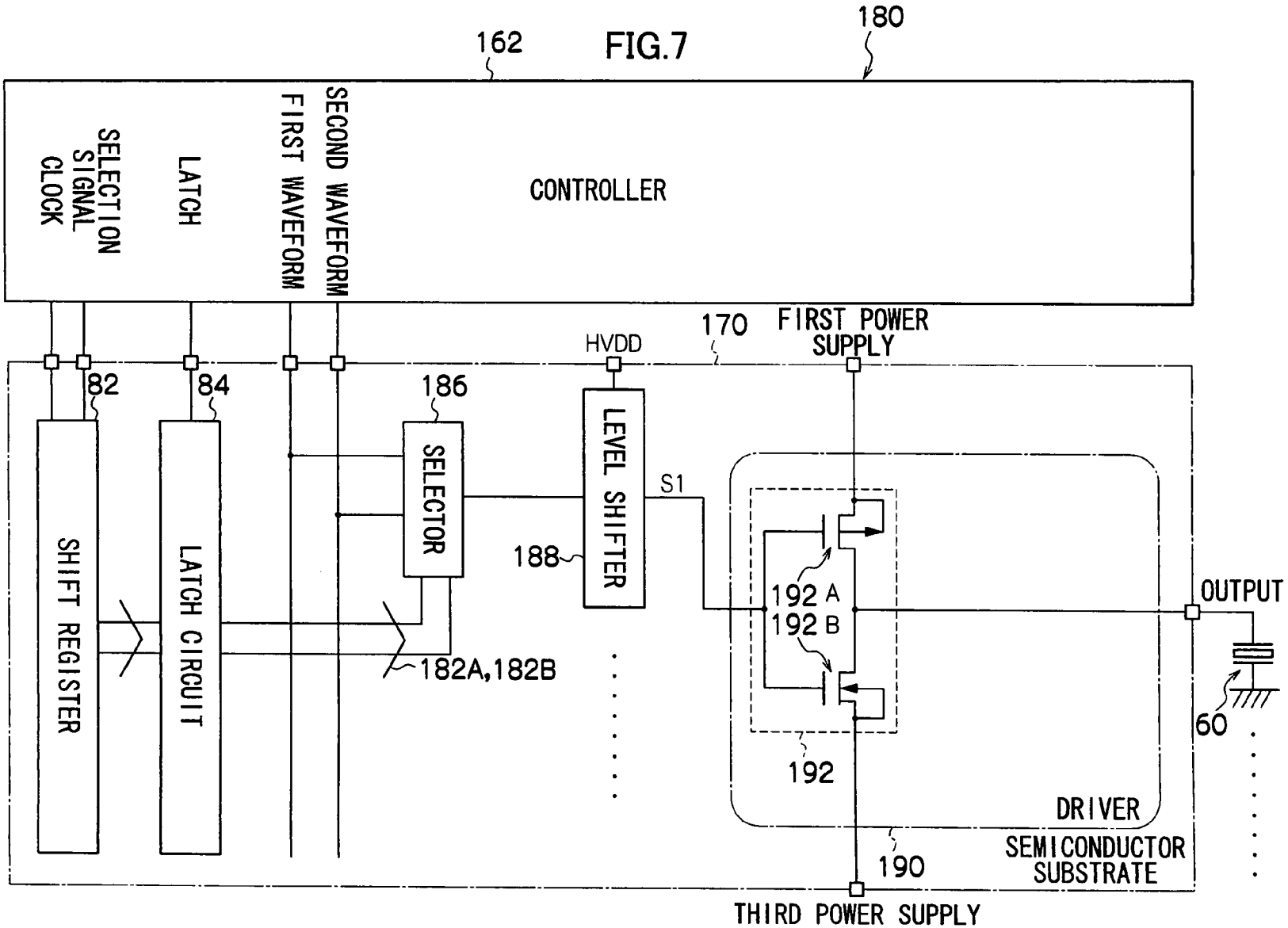
FIG. 7 is a circuit diagram showing a drive circuit of an inkjet recording apparatus according to the first embodiment of the invention.

As shown in FIG. 7, the second embodiment differs from the first embodiment in that only one signal generating circuit 192 is provided in a driver 190.

The signal generating circuit 192 is configured in the form of an inverter circuit in which PMOS 192A and NMOS 192B are connected in series. Electric power having the voltage level HV2 is supplied from the first power supply to the source of PMOS 192A, and electric power having the voltage level HV3 is supplied from the second power supply to the source of PMOS 192B. The gates of PMOS 192A and NMOS 192B are connected to the output terminal of a level shifter 188, and the waveform signal S1 is inputted to the gates of PMOS 192A and NMOS 192B. The waveform signal S1 is one of the waveform signals selected by a selector 186, and the waveform signal S1 is level-shifted by the level shifter 188.

For example, if the first waveform and the second waveform are used as the ejecting pulse waveform and the reverberation amplifying pulse waveform respectively, in the case where "1" is set at high and "0" is set at low in the pair of first waveforms, the level shifter 188 converts and outputs the voltage level by setting the first waveform at "0111111100" when the selector 186 selects the first waveform. The voltage has the voltage level HV2 when the waveform signal S1 is set at low "0", and the voltage has the voltage level HV3 when the waveform signal S1 is set at high "1". The voltage waveform of the ejecting pulse is shown on the left side of FIG. 6A.

For example, in the case where "1" is set at high and "0" is set at low in the pair of second waveforms, the level shifter 188 converts and outputs the voltage level by setting the second waveform at "0111100000" when the selector 186 selects the second waveform. Accordingly, the voltage has the voltage level HV2 when the waveform signal S1 is set at low "0", and the voltage has the voltage level HV3 when the waveform signal S1 is set at high "1". The voltage waveform of the reverberation amplifying pulse is shown on the right side of FIG. 6A.

In a drive circuit 180 of the second embodiment, the first waveform is stored in a controller 162 such that the pulse width of the outputted ejecting pulse becomes around ½ of the Helmholtz resonance period Tc of the inkjet head, and the second waveform is stored in the controller 162 such that the pulse width becomes smaller than Tc/2.

The selection signal is stored in the controller 62 such that the time interval between the ejecting pulse and the reverberation amplifying pulse becomes Tc/2.

When the controller 62 outputs the selection signal, the first waveform, and the second waveform, the ejecting pulse and reverberation amplifying pulse whose pulse widths are substantially set at ½ of the Helmholtz resonance period Tc are applied to the piezoactuator 60 while the time interval between the ejecting pulse and the reverberation amplifying pulse is set at substantially Tc/2.

Therefore, the pressure change having the same phase as the pressure change generated by the ejecting pulse is generated by the reverberation amplifying pulse. As shown in FIG. 6B, in the pressure change within the pressure chamber 56, the ratio of rise value B'/rise value A' becomes about ⅓ to about ½, and the reverberation of the pressure change is efficiently amplified. Accordingly, since the appropriate amount of reverberation pressure change can be obtained, the ink droplet is well separated from the meniscus to prevent the generation of the low-speed satellite drops and the mist.

Thus, according to the inkjet recording apparatus of the second embodiment, the circuit cost and power consumption can be decreased by the method in which the number of voltage levels is limited to two values and applying the voltage having a rectangular waveform. Particularly the method is an extremely effective voltage applying method for a full sheet-width application head (FWA head).

Figure 8A:
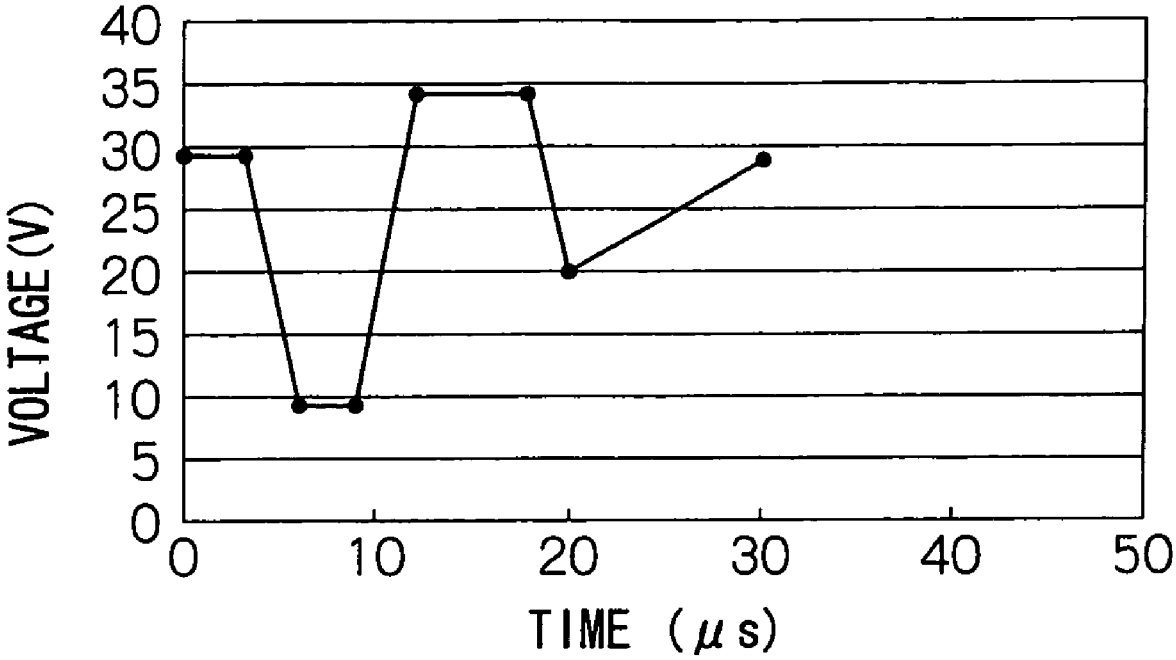
FIG. 8A shows voltage including a reverberation amplifying pulse applied to a piezoactuator according to a third embodiment of the invention.
Figure 8B:
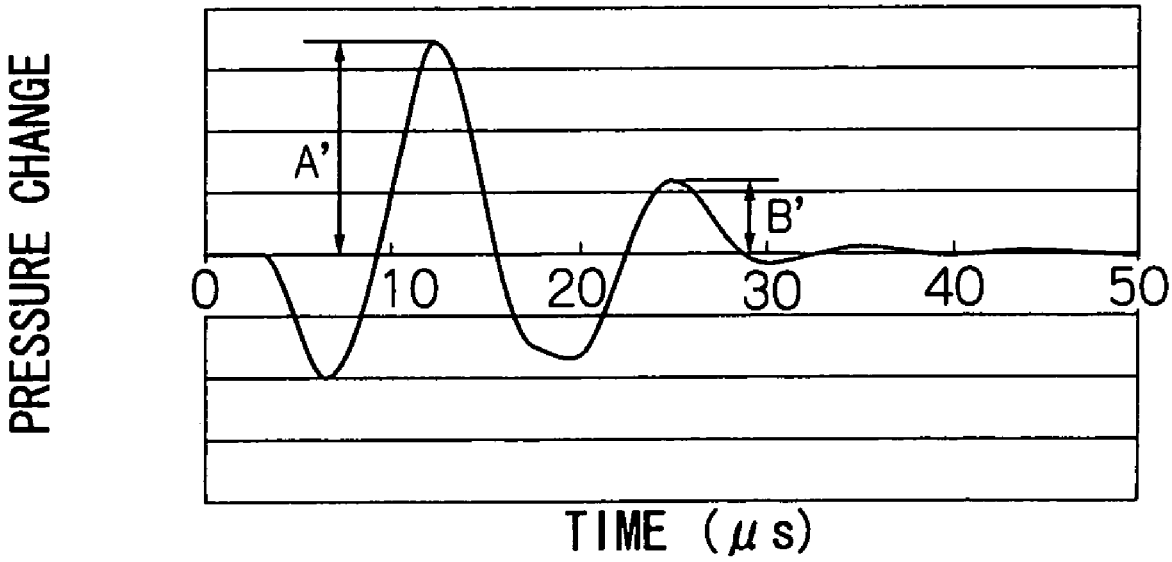
FIG. 8B shows a pressure change within a pressure chamber.

A third embodiment will be described below. In the third embodiment, the same components as the first embodiment are designated by the same numerals, and the description thereof will be omitted. As shown in FIG. 8, the third embodiment differs from the first embodiment in that the waveform of the voltage applied to the piezoactuator 60 is not a rectangular waveform but an analog waveform.

The waveform of the voltage applied to the piezoactuator 60 is characterized in that a reverberation amplifying voltage change c is added subsequent to the voltage changes a and b for ejecting the ink droplet. In the case of the analog waveform, since there is a degree of freedom in the voltage change amount and the voltage change time (rise and fall times), the reverberation amplifying voltage change can be set in various modes (waveforms). However, the pressure wave generated by the reverberation amplifying voltage change is set so as to have substantially the same phase as the pressure wave generated by the voltage changes a and b for ejecting the droplet.

Figure 9:
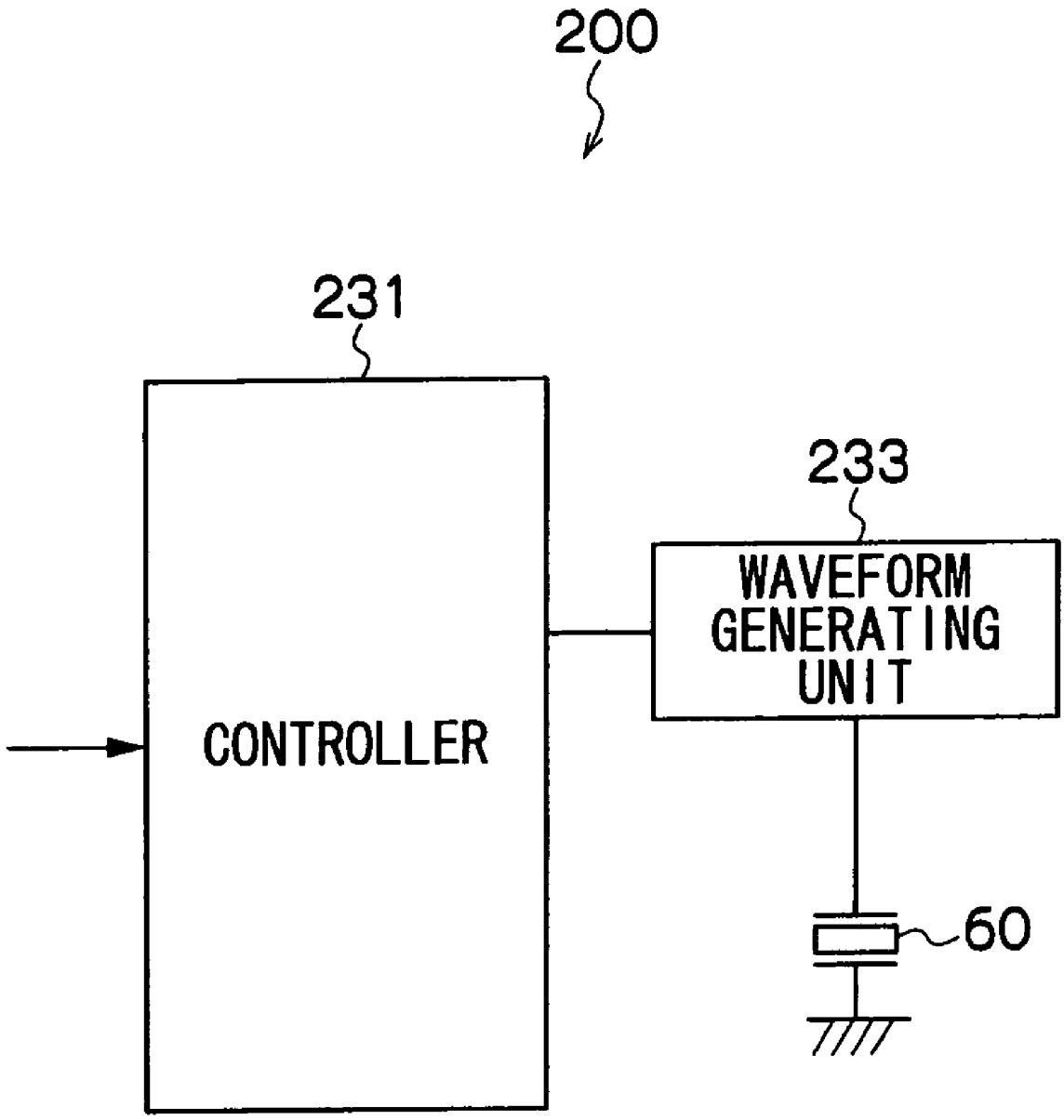
FIG. 9 is a block diagram showing a configuration of a control system of an inkjet recording apparatus according to the third embodiment of the invention.

Referring to FIG. 9, an inkjet recording apparatus 200 includes a waveform generating unit 233 and a controller 231. The waveform generating unit 233 generates a voltage having a predetermined waveform to apply the voltage to the piezoactuator 60. The controller 231 controls the drive of each component and the transmission and reception of each signal. The data (including waveform data exhibiting the analog waveform) necessary to drive the waveform generating unit 233 is stored in the controller 231.

When the waveform data exhibiting the analog waveform stored in the controller 231 is imparted to the waveform generating unit 233, the waveform generating unit 233 applies the voltage having the analog waveform to piezoactuator 60.

Thus, according to the inkjet recording apparatus of the third embodiment, the voltage having the analog waveform is applied to piezoactuator, so that the voltage change amount and the voltage change time (rise and fall times) can freely be set to easily realize the prevention of the generation of low-speed satellite drops and the mist.

A fourth embodiment will be described below. In the fourth embodiment, the same components as the first embodiment are designated by the same numerals, and the description thereof will be omitted. The fourth embodiment differs from the first embodiment in that the waveform of the voltage applied to the piezoactuator 60 is corrected based on an environmental temperature or temperatures of the inkjet head 50.

In the case of the use of high-viscosity ink, an extremely large viscosity change is generated by an environmental temperature change, with the ink viscosity being 10 mP.s at the environmental temperature of 35° C. and the ink viscosity is 20 mP.s at the environmental temperature of 15° C. (in the fourth embodiment the viscosity change is 20–10=10 cP). Therefore, not only the ejection efficiency is changed, but also the speed of attenuation of the pressure change is changed greatly. Because the state of satellite drop generation cannot be kept constant merely by correcting the voltage level of the ejecting pulse in order to correct the ejection efficiency change, low temperatures where the ink viscosity is increased are more susceptible to low-speed satellite drop generation.

Therefore, in the fourth embodiment, a temperature sensor for detecting the environmental temperature is placed in the apparatus, or a temperature sensor for detecting the temperature of the inkjet head 50 is provided in the inkjet head 50, and the voltage level of the reverberation amplifying pulse is corrected according to the detected temperature. To this end, the controller 62 controls the second power supply, which supplies electric power having the voltage level HV2, and the third power supply, which supplies electric power having the voltage level HV3, based on the temperature detected by the temperature sensor.

Figure 10A:
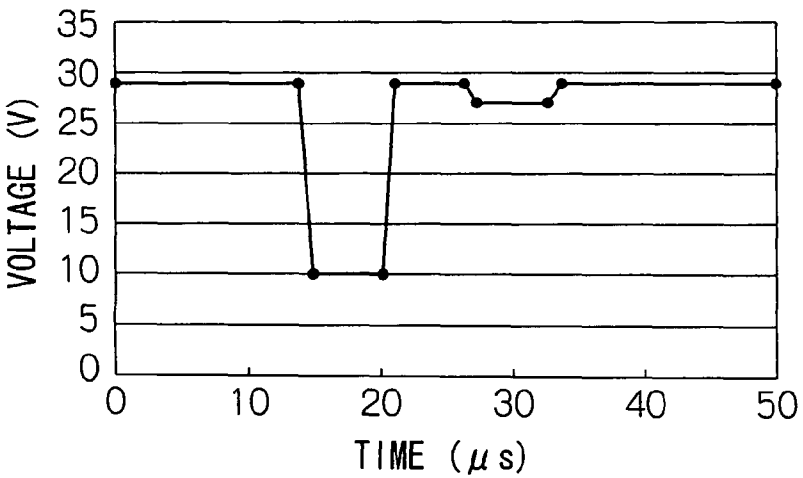
FIG. 10A shows a voltage including a reverberation amplifying pulse applied to a piezoactuator according to a fourth embodiment of the invention at high temperature.

A case in which a temperature sensor placed in the apparatus detects the environmental temperature will be described below. As shown in FIG. 10A, when the detected environmental temperature is 35° C., the controller 62 performs control such that, for example, the voltage level HV3 of the electric power supplied from the third power supply becomes 10V, and the voltage level HV2 of the electric power supplied from the second power supply becomes 26V.

Figure 10B:
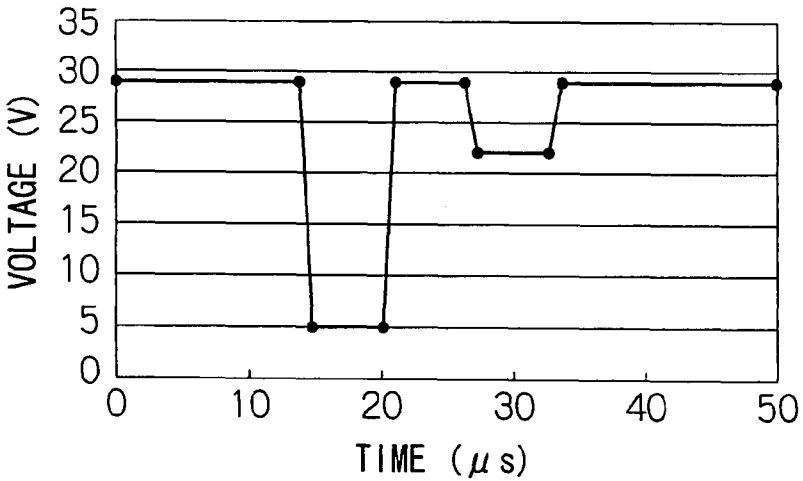
FIG. 10B shows a pressure change within a pressure chamber at high temperature.

As shown in FIG. 10B, when the temperature sensor detects a low environmental temperature (for example, 15° C.), the controller 62 performs control such that, for example, the voltage level HV3 of the electric power supplied from the third power supply becomes 5V, and the voltage level HV2 of the electric power supplied from the second power supply becomes 22V.

A table in which the voltage levels HV2 and HV3 are correlated with the environmental temperature is stored in the controller 62. The controller 62 controls the voltage level HV2 of the electric power supplied from the second power supply and the voltage level HV3 of the electric power supplied from the third power supply based on the table.

Figure 10C:
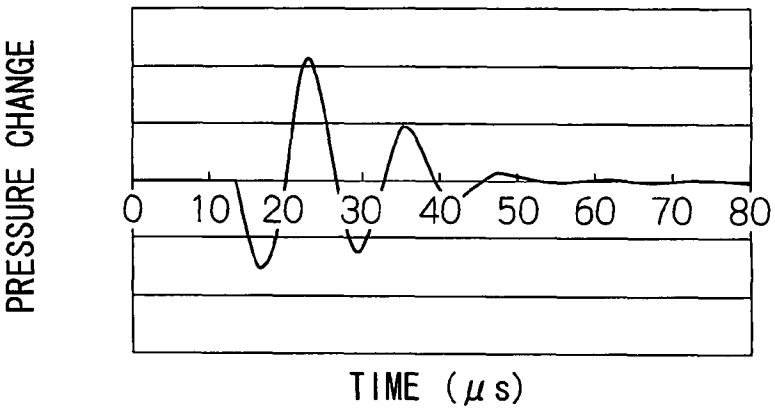
FIG. 10C shows a voltage including the reverberation amplifying pulse at low temperature.
Figure 10D:
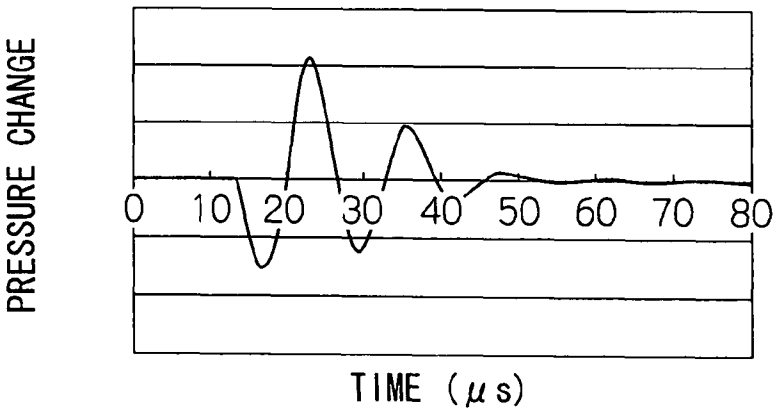
FIG. 10D shows the pressure change within the pressure chamber at low temperature.

Accordingly, the specific pressure changes and reverberation pressure changes can be obtained as shown in FIGS. 10C and 10D, even if the environmental temperature is changed.

In the fourth embodiment, the voltage applied to the piezoactuator 60 has three voltage levels. However, the voltage level may have binary values.

Figure 11A:
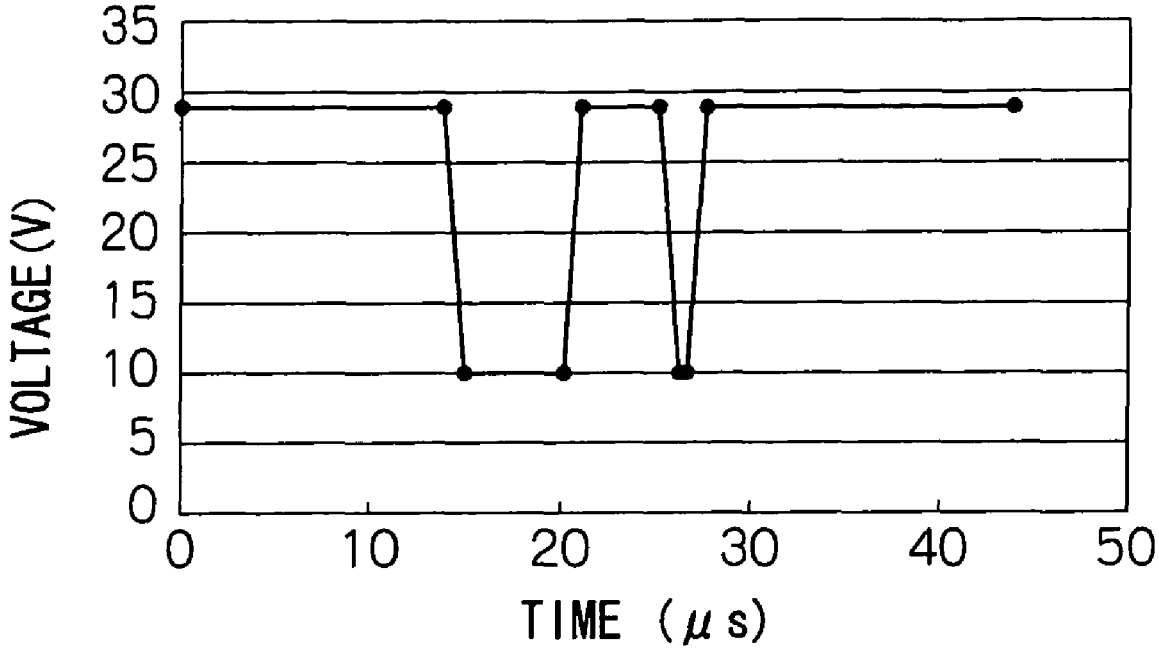
FIG. 11A shows the voltage including the reverberation amplifying pulse applied to the piezoactuator according to an example of the fourth embodiment of the invention at high temperatures in the case of a binary voltage level, and FIG. 11B at low temperatures.
Figure 11B:
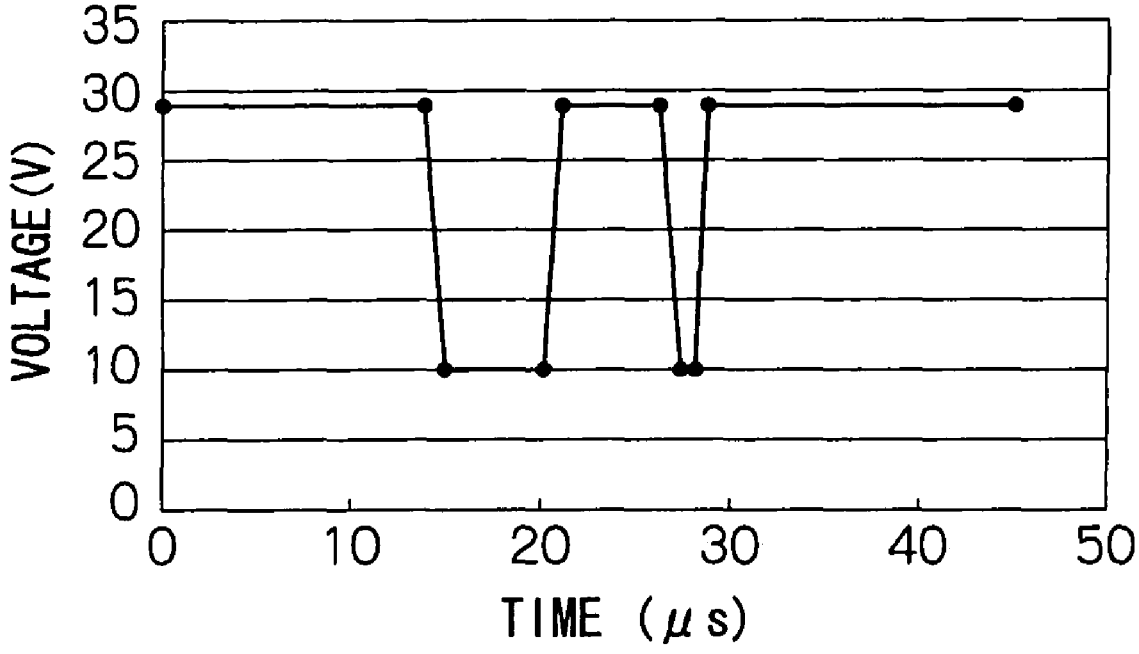

In the case of the binary voltage levels, since the voltage level of the reverberation amplifying pulse cannot be corrected, as shown in FIG. 11A and B, the time interval between the ejecting pulse and the reverberation amplifying pulse is corrected according to the environmental temperature detected by the temperature sensor. The closer the time interval between the ejecting pulse and the reverberation amplifying pulse is brought to Tc/2, the larger reverberation amplifying action is obtained. Therefore, in low temperatures at which the ink viscosity is increased, as shown in FIG. 11B, the timing of the reverberation amplifying pulse application is set such that the time interval between the ejecting pulse and the reverberation amplifying pulse substantially becomes Tc/2. At high temperatures where the ink viscosity is decreased, as shown in FIG. 11A, the application timing of the reverberation amplifying pulse can be set to obtain the appropriate amount of reverberation pressure change such that the time interval between the ejecting pulse and the reverberation amplifying pulse is shifted away from Tc/2.

Figure 12A:
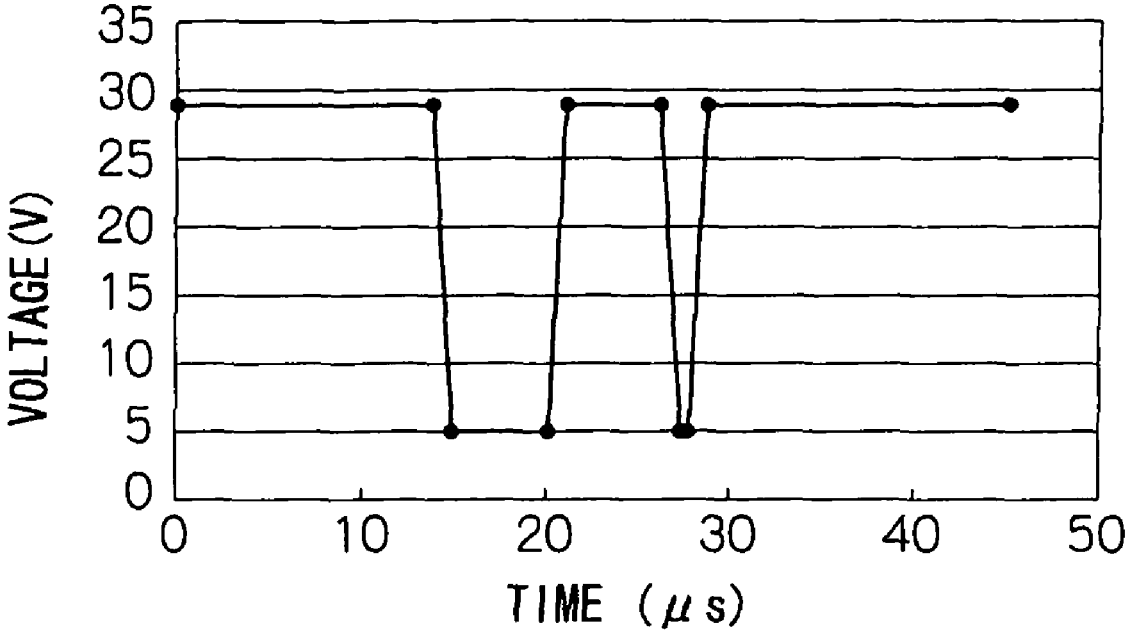
FIG. 12A shows the voltage including the reverberation amplifying pulse applied to the piezoactuator according to another example of the fourth embodiment of the invention at high temperatures in the case of the binary voltage level, and FIG. 12B at low temperatures.
Figure 12B:
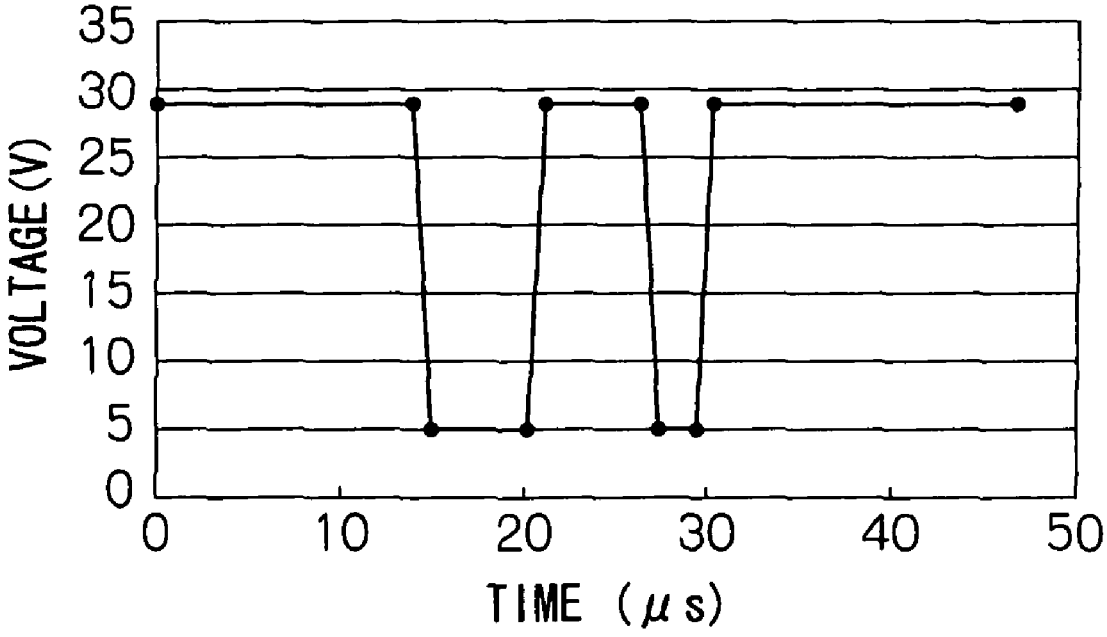

Further, the pulse width of the reverberation amplifying pulse may be corrected as shown in FIG. 12A and B. The larger the pulse width of the reverberation amplifying pulse becomes, the larger reverberation amplifying action can be obtained. Therefore, as shown in FIG. 12B, the pulse width of the reverberation amplifying pulse is set larger at low temperatures where the ink viscosity is increased. At high temperatures where the ink viscosity is decreased, the pulse width of the reverberation amplifying pulse is set smaller, as shown in FIG. 12A.

Thus, according to the inkjet recording apparatus of the fourth embodiment, the application timing of the reverberation amplifying pulse, the voltage level, or the pulse width is corrected according to the environmental temperature or the temperature of the inkjet head, in order to obtain the appropriate reverberation pressure change even if the environmental temperature or the temperature of the inkjet head is changed. Therefore, the generation of the low-speed satellite drops and mist can effectively be prevented even if the liquid viscosity is changed by the temperature.

According to the invention, the droplet ejecting voltage including the ejecting pulse is applied to the electromechanical transducer to generate the pressure change in the pressure chamber, and the voltage including the reverberation amplifying pulse is applied to the electromechanical transducer to amplify the pressure change in the next subsequent cycle to the cycle of the pressure change generated by the ejecting pulse in the pressure chamber. Therefore, the reverberation pressure change is amplified after the droplet is ejected, and the appropriate amount of reverberation pressure change can be obtained, so that the droplet is well separated when ejecting the droplet.

Accordingly, when the voltage including the reverberation amplifying pulse for amplifying the pressure change in the next cycle subsequent to the cycle of the pressure change generated by the ejecting pulse is applied to the electromechanical transducer, the reverberation pressure change is amplified after the droplet is ejected, and the droplet is well separated when ejecting the droplet, so that the generation of low-speed satellite drops and mist can effectively be prevented and the degradation of the image quality can be prevented.

According to the invention, the voltage can have a rectangular waveform having two voltage levels or three voltage levels. Therefore, the circuit cost and power consumption can be decreased.

According to the invention, the pulse width of the ejecting pulse can be set at substantially ½ of the resonance period of the pressure change. Therefore, the pressure can efficiently be changed in the pressure chamber.

According to the invention, the time interval between the ejecting pulse and the reverberation amplifying pulse can be set at substantially ½ the resonance period of the pressure change. Therefore, a pressure change having the same phase as the pressure change generated by the ejecting pulse is generated by the reverberation amplifying pulse, and the reverberation pressure change can efficiently be amplified.

According to the invention, the voltage has a rectangular waveform including binary voltage levels, and the pulse width of the reverberation amplifying pulse can be set smaller than ½ of the resonance period of the pressure change. Therefore, the reverberation pressure change can be appropriately amplified, and the generation of low-speed satellite drops and mist can effectively be prevented.

According to the invention, the voltage has a rectangular waveform including three-value voltage levels, and the pulse width of the reverberation amplifying pulse can substantially be set at ½ of the resonance period of the pressure change.

The droplet ejecting apparatus according to the invention can further include a detection unit for detecting either the environmental temperature or the temperature of the droplet ejecting head and correction unit for correcting at least any one of the application timing, the pulse width, and/or the voltage change amount of the reverberation amplifying pulse according to the temperature detected by the detection unit.

Accordingly, even if the liquid viscosity is changed by the environmental temperature, the appropriate reverberation pressure change can be obtained to effectively prevent the generation of low-speed satellite drops and mist.

According to the invention, the liquid viscosity can be set to 10 mP.s or more.

In the case where the ink has a large viscosity, the pressure change is rapidly attenuated in the pressure chamber and a reverberation pressure change suitable to the prevention of low-speed satellite drops cannot be obtained. However, according to the invention, the generation of the low-speed satellite drops can be prevented.

The applying unit according to the invention can apply the voltage to the electromechanical transducer such that the ratio of the amplitude of the cycle pressure change generated by the ejecting pulse in the pressure chamber divided into the amplitude of the pressure change in the next subsequent cycle is within the range from ⅓ to ½. Therefore, a reverberation pressure change in which the generation of low-speed satellite drops and mist can effectively be prevented can be obtained.

According to the invention, a piezoactuator can be used as the electromechanical transducer. Therefore, the droplet ejected by the droplet ejecting head can be controlled with high accuracy.

As described above, according to the droplet ejecting apparatus and droplet ejecting method of the invention, by changing the voltage, including the reverberation amplifying pulse for amplifying the pressure change in the next cycle subsequent to the cycle of the pressure change generated by the ejecting pulse in the pressure chamber, applied to the electromechanical transducer, the reverberation pressure change is amplified after the droplet is ejected and the droplet is well separated when ejecting the droplet. Accordingly, the effect that the generation of low-speed satellite drops and mist can effectively be prevented and the ability to prevent degradation of the image quality, can be obtained.

What is claimed is:

1. A droplet ejecting apparatus including a pressure chamber filled with a liquid and an electromechanical transducer which changes the pressure in said pressure chamber according to an applied voltage, the droplet ejecting apparatus comprising:

a droplet ejecting head which ejects a droplet according to said pressure change; and an applying unit which applies the voltage including an ejecting pulse and a reverberation amplifying pulse to said electromechanical transducer, the ejecting pulse ejecting said droplet and having a pulse width set at substantially ½ of the resonance period of said pressure change, the reverberation amplifying pulse being applied to said electromechanical transducer after the ejecting pulse, an interval between said ejecting pulse and said reverberation amplifying pulse being set at substantially ½ of the resonance period of said pressure change, and the reverberation amplifying pulse amplifying the pressure change in the next cycle of said droplet ejecting head subsequent to the cycle of the pressure change generated by said ejecting pulse in said pressure chamber.

2. The droplet ejecting apparatus according to claim 1, wherein said voltage has a rectangular waveform including at least two voltage levels or three voltage levels.

3. The droplet ejecting apparatus according to claim 1, wherein said voltage has a rectangular waveform including two voltage levels, and the pulse width of said reverberation amplifying pulse is set smaller than ½ of the resonance period of the pressure change.

4. The droplet ejecting apparatus according to claim 1, wherein said voltage has a rectangular waveform including three voltage levels, and the pulse width of said reverberation amplifying pulse is set at substantially ½ of the resonance period of the pressure change.

5. The droplet ejecting apparatus according to claim 1, further comprising:

detection unit for detecting either an environmental temperature or a temperature of said droplet ejecting head; and correction unit for correcting at least any one of the application timing, the pulse width, and/or the voltage change amount of said reverberation amplifying pulse according to the temperature detected by said detection unit.

6. The droplet ejecting apparatus according to claim 1, wherein viscosity of said liquid is set at 10 mP.s or more.

7. The droplet ejecting apparatus according to claim 1, wherein said applying unit applies said voltage to said electromechanical transducer such that a ratio of the amplitude of the next subsequent cycle pressure change in said pressure chamber to the amplitude of the pressure change generated by said ejecting pulse is within the range from ⅓ to ½.

8. The droplet ejecting apparatus according to claim 1, wherein said electromechanical transducer is a piezoactuator.

9. A droplet ejecting method, for a droplet ejecting apparatus including a pressure chamber filled with a liquid, an electromechanical transducer which changes the pressure in said pressure chamber according to an applied voltage, and a droplet ejecting head which ejects a droplet according to said pressure change, comprising applying a voltage including an ejecting pulse and a reverberation amplifying pulse to said electromechanical transducer, the ejecting pulse having a pulse width set at substantially ½ of the resonance period of said pressure change, the reverberation pulse being applied to said electromechanical transducer after the ejecting pulse, and an interval between said ejecting pulse and said reverberation amplifying pulse being set at substantially ½ of the resonance period of said pressure change, ejecting said droplet using the ejecting pulse, and amplifying the pressure change in said pressure chamber in the next cycle of said droplet ejecting head subsequent to the cycle of the pressure change generated by said ejecting pulse using the reverberation amplifying pulse.

* * * * *